United States Patent [19]

Edmonds et al.

[11] Patent Number: 4,538,395

[45] Date of Patent: Sep. 3, 1985

[54] METHOD OF CHARGING AND HERMETICALLY SEALING A HIGH PRESSURE GAS VESSEL

[76] Inventors: David A. Edmonds, Rte. 1, Box 169, King George, Va. 22485; Winfred B. Rollins, Box 342, Dahlgren, Va. 22448

[21] Appl. No.: 444,105

[22] Filed: Nov. 24, 1982

[51] Int. Cl.[3] ..... B65B 31/02; B67B 1/04

[52] U.S. Cl. ..... 53/403; 53/404; 53/488; 53/489; 53/490

[58] Field of Search ..... 53/80, 88, 89, 97, 101, 53/264, 331.5, 317, 318, 403, 404, 489, 490, 421, 319, 488; 220/258, 315, 359

[56] References Cited

U.S. PATENT DOCUMENTS

| | | | |
|---|---|---|---|
| 1,100,439 | 6/1914 | Mauran | 53/88 X |
| 2,104,322 | 1/1938 | Gutmann | 220/258 |
| 2,897,642 | 8/1959 | Jones et al. | 53/403 |
| 3,577,696 | 5/1971 | Bock et al. | 53/403 |
| 3,844,089 | 10/1974 | Forry | 53/88 |
| 3,952,395 | 4/1976 | Crossman et al. | 29/401 |
| 4,255,916 | 3/1981 | Blankenship | 53/404 |

FOREIGN PATENT DOCUMENTS

| | | | |
|---|---|---|---|
| 554948 | 6/1923 | France | 220/258 |
| 257074 | 2/1928 | Italy | 220/258 |
| 257496 | 9/1926 | United Kingdom | 220/258 |

*Primary Examiner*—John Sipos
*Assistant Examiner*—Donald R. Studebaker
*Attorney, Agent, or Firm*—Robert F. Beers; Kenneth E. Walden

[57] ABSTRACT

Apparatus for and method of charging and hermetically sealing a small pressure vessel for confining therein a highly pressurized gas for a shelf life of several years. The vessel has a boss or neck with a very small opening extending longitudinally therethrough defining a fill connection which terminates in a small sharp edged cylindrical lip at its outer extremity into and around which a ductile metal is extruded under pressure for establishing a seal.

1 Claim, 4 Drawing Figures

FIG. 1
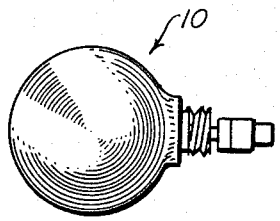
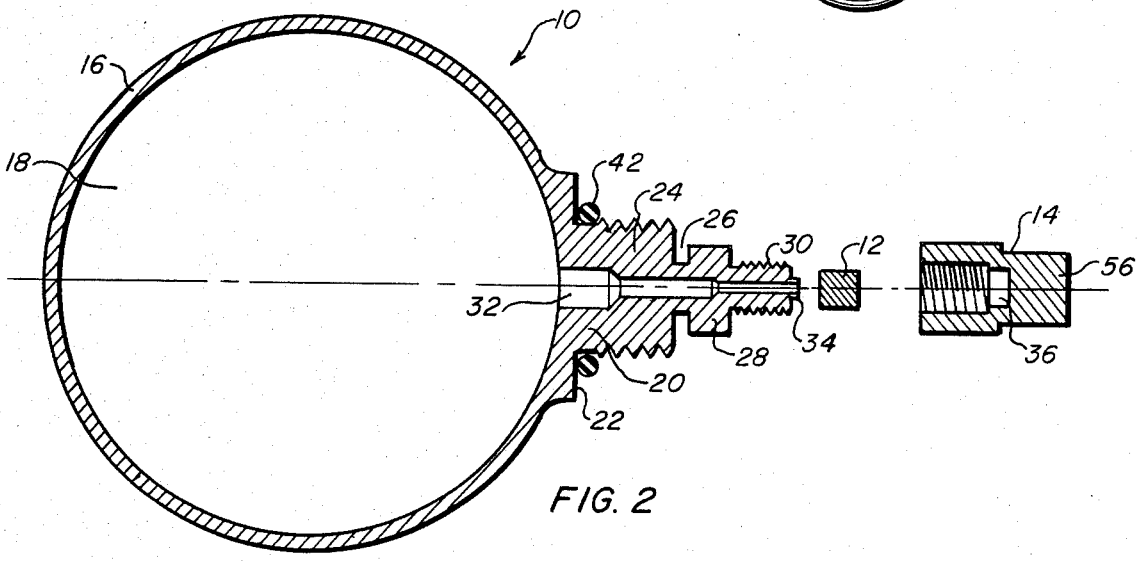
FIG. 2
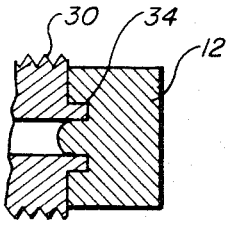
FIG. 4
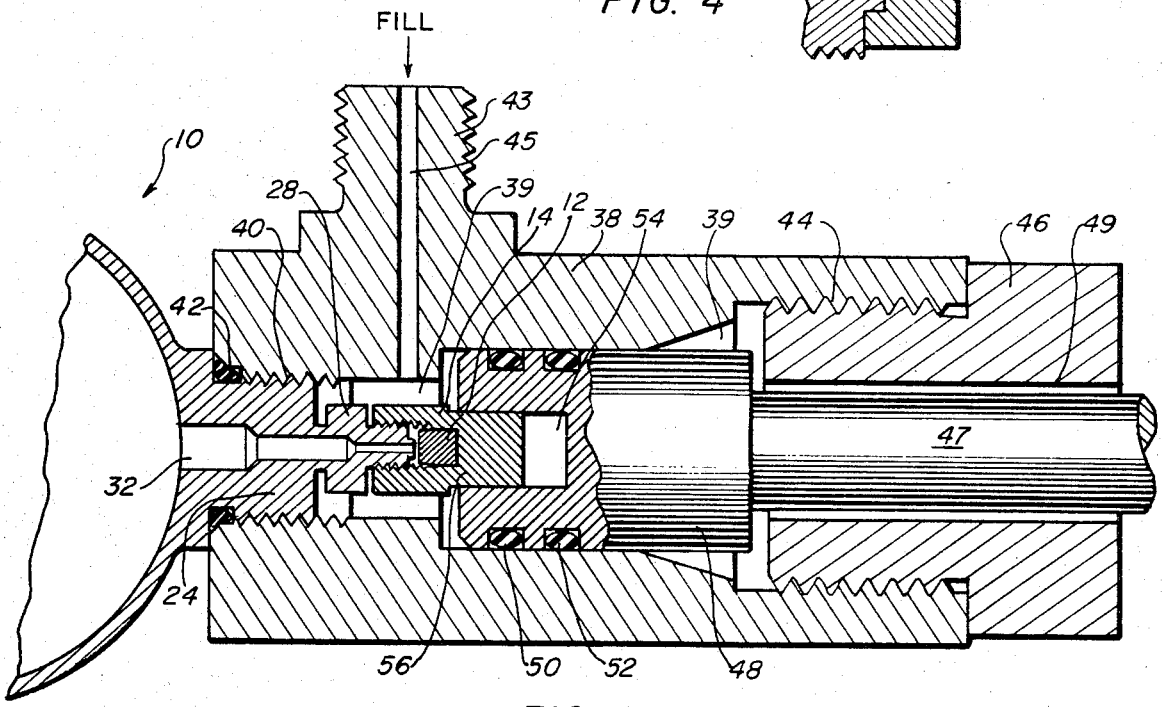
FIG. 3

METHOD OF CHARGING AND HERMETICALLY SEALING A HIGH PRESSURE GAS VESSEL

BACKGROUND OF THE INVENTION

Guided missiles and projectiles have need for a compact short life source of pressurized gas on board to aid guidance systems and cool infrared detectors during inflight. A small pressure vessel hermetically sealed according to the invention retains a highly pressurized gas for this function. In flight, once the pressurized gas is selectively released from its container, it flows through a system to provide energy for uncaging gyroscopes, cooling infrared detectors, and maneuvering control surfaces.

One of the problems encountered with the use of the small highly pressurized vessels is that no method has been developed for effectively sealing in the pressurized gases to provide it with a long shelf life whereby the missile or projectile in which it is used can be stored for an extended time and have high reliability when called upon.

Sealing of highly pressurized vessels is the subject of many patents, but none provide high reliability over an extended period and many of the arrangements for accomplishing the task are complicated and awkward to perform. Some arrangements call for a bottle to be filled inside a larger pressurized vessel. See, for example, U.S. Pat. No. 3,577,696 where highly pressurized gas is introduced into the bottle by leaking it past loosely engaged cap threads, and after pressurization, the cap is tightened to compress a seal element to prevent leakage. This arrangement defines nothing more than a gasket which, in time, for many reasons, allows leakage of pressurized gas, and is, therefore, not reliable. This is not an acceptable method for use on the container disclosed herein because its thin fragile reduced neck portion will not withstand the high torque necessary to compress a gasket.

Compressed or soldered pigtails have long been used for sealing a fill neck of a container, but this involves difficult working arrangements at elevated pressures and, furthermore, the final seal is unreliable.

A tool for filling and sealing a pressurized vessel is disclosed in U.S. Pat. No. 3,844,089. It teaches the sealing of a fill opening by wedging a plug radially outwardly into contact with passage walls. Neither does this disclosure provide an effective and reliable seal for extremely high pressures over an extended life.

U.S. Pat. No. 3,952,395 teaches the method of plugging and sealing a hole in a ductile material by press fitting therein a spherical ball of the same type material. This method cannot be applied to the pressurized vessel disclosed herein because it cannot be of a ductile material due to the very high pressurized gases which it must contain.

One method of sealing a pressure vessel identical to the one disclosed herein for confining highly pressurized gas is disclosed in U.S. Pat. No. 4,255,916 assigned to the United States, as represented by the Secretary of the Navy, and upon which the present invention is an improvement. While its structure and operation is fully described in the patent, brief reference will be be made thereto. Solder joint 25 in that patent is first established between the bottom of valve body 16 and mounting flange 15. Then, a source of highly pressurized gas is coupled to inlet 20 of valve body 16 and allowed to flow past ball 18 and on through the passage to chamber 11.

When the desired pressure is reached within chamber 11, the charging line is removed from inlet port 20 and pressure acting against plastic ball 18 from inside the chamber seats it against valve seat 24 to define only a temporary seal. Immediately thereafter, inlet port 20 is closed by applying solder 26. The problem with the arrangement and method taught in U.S. Pat. No. 4,255,916 is that each solder joint is under a constant high pressure and will eventually leak. As mentioned, seated ball 18 provides only a temporary seal until solder joint 26 is established. The fact is that the temporary seal allows continuous leaking of a small amount of the highly pressurized gas even while solder 26 is being applied and while setting. This interferes with hermetic integrity of the joint. It has become known to applicants by microscopic examination of solder joint 26 that gas leaking past the temporary seal of ball 18 forms small passages through and around the solder before setting has occurred. These passages permit continued minute leakage of the pressurized gas which eventually allows its complete dispersion from changer 16.

The improved sealing arrangement herein is directed toward overcoming the identified shortcomings in the prior art and especially those in U.S. Pat. No. 4,255,916.

SUMMARY OF THE INVENTION

The present invention is directed to a hermetic seal for a vessel containing highly pressurized gas. The invention more specifically is directed to forming the end of the vessel fill neck with a small sharp cylindrical lip onto which a ductile metal is forced by axial pressure. The metal is caused to flow or extrude into and around the lip for sealing it from outward flow of pressurized gas. Since the opening is small, only a few pounds force can be applied by the pressurized gas against the metal seal.

The pressurized vessel is used in guided missiles or projectiles to provide a power source for their operation and control during flight to a target.

It is, therefore, an object of the invention to provide a hermetic seal for a highly pressurized vessel for assuring its long shelf life.

It is another object of the invention to provide a seal on a pressurized vessel which may be easily established under pressurized conditions after the vessel is charged.

It is still another object of the invention to provide a seal on a pressurized container without the need of close tolerance machine fits between mating parts.

It is yet another object of the invention to provide a seal on a pressurized container upstream of any threadings, gaskets or solder joints.

Other objectives of the invention will become apparent to one skilled in the art upon considering the specification in conjunction with the drawings forming a part hereof.

BRIEF DESCRIPTION OF THE DRAWINGS

FIG. 1 is a side view at substantially full scale of a small spherical pressure vessel to which the present sealing arrangement is applied.

FIG. 2 is an enlarged exploded cross-sectional view of the pressure vessel (empty) and sealing apparatus.

FIG. 3 is an enlarged cross-sectional view of the pressure vessel, gas filling and sealing apparatus.

FIG. 4 is a greatly enlarged cross-sectional representation of the ductile or malleable metal plug after having been pressed into sealing position on the cylindrical lip.

DETAILED DESCRIPTION OF THE PREFERRED EMBODIMENT

Referring now to the drawings, there is illustrated in FIG. 1 a side view of pressure vessel 10, the neck of which is hermetically sealed according to the present invention. The vessel is shown at substantially full scale to illustrate its minute size and the difficulty likely to be encountered in sealing it.

FIG. 2 is a greatly enlarged cross sectional view of an empty pressure vessel 10 with its cylindrical sealing plug 12 and threaded cap 14 disposed in spaced relationship therewith. Pressure vessel 10 comprises a strong thin wall spherical shell 16 enclosing a chamber 18 capable of receiving and holding pressurized gas up to and around 7,000 psi. The pressure vessel includes an integrally formed boss portion 20 having a square shoulder 22 and a threaded shank 24. The shank is adapted to receive O-ring 42 against the shoulder for providing a seal as illustrated in FIG. 3. Boss 20 is provided with a region 26 of reduced diameter and a mounting flange 28 immediately outward thereof. The outer end 30 of the boss is threaded to receive threaded cap 14. A plurality of aligned small drilled holes 32 disposed axially of boss 20 define a passageway for gas communication to and from chamber 18. It will be noted in FIG. 2 that the drilled passageway through region 26 of reduced diameter leaves a very thin wall. The drilled hole and reduced diameter region 26 are intentionally sized to leave a cylindrical wall thickness of only a few thousandths of an inch for a purpose to be described later.

Threaded outer end 30 of boss 20 terminates in an axially extending cylinder lip 34 surrounding the small passageway. This lip may terminate in a sharpened edge. It will be appreciated that lip 34 is extremely small when it is remembered that it is applied to the end of the neck of pressurized vessel 10 illustrated at substantially full scale at FIG. 1.

Plug 12, illustrated in exploded FIG. 2, is just spaced from lip 34, is in the form of a solid cylinder of a malleable or ductile material, e.g., copper. Cap 14 includes a cylindrical recess 36 just behind its internal threads sized to receive plug 12. Whenever cap 14 is threaded over extension 30, soft metal plug 12 is brought into contact with cylindrical lip 34 to form a seal which is clearly illustrated in greatly enlarged FIG. 4. The wall forming the cylindrical lip is thin and accordingly terminates in a sharp edge even though illustrated as square in FIG. 4. The edge may be machined or ground at an angle to provide an even sharper edge.

Apparatus for charging pressure vessel 10 and sealing it is illustrated in FIG. 3. The charging apparatus includes a housing 38 having a central chamber 39 extending therethrough. One end of the chamber is provided with an internally threaded portion 40 into which shank 24 of an empty pressure vessel 10 is tightly threaded to compress O-ring 42 therebetween for establishing a hermetically sealed joint. The housing further includes a threaded boss 43 defining a fill connection for connection with a source of pressurized gas. An opening 45 extends through the boss portion to the central chamber for defining a passage for conducting gas to charging the pressure vessel. The other end of the central chamber is provided with a threaded recess 44 for receiving threaded retainer gland 46.

Pressure vessel 10 is first threaded into housing 38, as illustrated in FIG. 3. Its fill neck extends axially into the central chamber with sharp cylindrical lip 34 exposed. The next step is to thread cap 14, which carries plug 12, into position on extension 30. This is accomplished manually by the use of a special tool 47 which is illustrated only in position within cavity 39. The tool included a shank 49 to define a handle and the other end terminates in a cylindrical head portion 48 which includes a hexagonal socket 54 adapted to receive a hexagonal head of cap 14 in much the same manner as a socket wrench holds a nut. With tool 47 outside housing 38, end 56 of cap 14 is manually inserted into recess 54 of head portion 48. The outer cylindrical surface of tool head portion 48 is provided with a pair of axially spaced apart annular grooves for carrying O-rings 50 and 52. When tool 47, carrying cap 14 in its socket, is inserted into central chamber 39, as illustrated in FIG. 3, the O-rings define a temporary seal with its walls. Chamber 39 is, of course, not pressurized at this stage. Tool 47 is pressed forward and turned to engage the threads of cap 14 with the threads of extension 30 of the vessel neck. Cap 14 is threaded down further until light contact is felt between the end of plug 12 and lip 34. Tool 47 is then backed off about one turn to allow spacing between lip 34 and plug 12.

With gland 46 in position behind tool 47, apparatus is now in position for charging pressure vessel 10 with highly pressurized gas from an outside source. It will be realized from an examination of the elements as arranged in FIG. 3 that passages are established leading from boss 43 fill opening or inlet 45 into chamber 18. Pressurized gas from a source (not illustrated) is connected to threaded boss 43 from which it travels down opening 45 to chamber 39, through the space between the end of cap 14 and face of mounting flange 28, between the threads of cap 14 and extension 30, around lip 34 in the space in front of plug 12, into passageway 32, and into chamber 18 of pressure vessel 10.

Upon complete pressurization of chamber 18, tool 47 is turned further to a final torque of 12 inch-ounces which is sufficient to seat the relatively soft or malleable metal of plug 12 against lip 34 with sufficient axial force to cause the metal to flow or extrude around the lip outer periphery and into its internal opening to define a seal for hermetically sealing the passageway.

During the charging and sealing operation only a minimal amount of gas may have leaked from chamber 39 past the O-ring seals. What may have leaked is of no consequence.

Certain steps must be taken before the now pressurized and sealed vessel can be removed from housing 38. First, the source of pressurized gas is closed and disconnected. Gland 46 is unthreaded to allow tool 47 to be axially withdrawn, without turning, to leave cap 14 in threaded position on the neck of the pressure vessel to maintain pressure on plug 12. The vessel may then be unthreaded from housing 38, and is ready for subsequent installation in a missile or projectile for future use with assurance of an extended shelf life.

The metal forming the pressure vessel and neck has been heat treated for added strength for holding the highly pressurized gas up to as much as 7,000 psi with a substantial safety factor. Heat treating, while strengthening the metal may render it subject to fracture under the force of a sharp blow. As mentioned, the wall surrounding the passageway through reduced region 26 is only a few thousandths of an inch thick. While such a thin wall is sufficiently strong to retain pressurized gas, it will rupture when struck by a sharp blow to release the pressurized gas.

The pressurized vessel is used with guided missiles or projectiles as follows. Threaded boss 24 is secured in a complementary opening of a gas manifold in the missile or projectile. A cartridge device (not illustrated) is actuated at the appropriate time to strike a blow laterally against an outer portion of the fill neck to cause fracture at reduced region 26 and permit gas confined in chamber 18 to escape through passage 32 to the manifold for distribution as required to uncage the gyros and provide continuous cooling for the detector of an infrared seeker forming part of the guidance system.

It will be apparent that the present invention has advantages over the prior art. For example, vessel 10 may be charged under atmospheric conditions without the need for enclosing it within a pressized vessel. Furthermore, any leakage of gas past the temporary seals is vented to the atmosphere without interference with the formation of solder joints. Parts of the vessel need not be manufactured to highly restrictive tolerances. Further, the seal established by extruding the soft or malleable metal into and around the cylinder lip is upstream of any threading or solder joints thereby avoiding leakage at such inviting places. The charging of the vessel according to the present apparatus and procedure is relatively simple and opportunity for leakage is minimized.

Obviously many modifications or variations can be made to the present invention without departing from the spirit of the above-described apparatus and method of use. The scope of the invention is limited only by the claims annexed hereto.

We claim:

1. A method of charging the chamber of a metal pressure vessel with a highly pressurized gas and thereafter hermetically sealing it for a long shelf life comprising:

providing a pressure vessel with a boss having a small opening extending therethrough terminating at its outer extremity for defining a fill passageway for the chamber;

providing the boss outer extremity with a hard cylindrical lip immediately surrounding the small opening and extending axially beyond the boss outer extremity;

pressurizing the vessel through the small opening;

forcing malleable metal axially against the sharp cylindrical lip for causing the metal to extrude both inside and outside the cylindrical lip for establishing a hermetic seal therewith; and, continue forcing the metal in extrusion until it abuts the boss outer extremity.

* * * * *